US010758945B2

(12) United States Patent
Yao et al.

(10) Patent No.: US 10,758,945 B2
(45) Date of Patent: Sep. 1, 2020

(54) LIQUID KNIFE, LIQUID KNIFE CLEANING APPARATUS AND LIQUID KNIFE ASSEMBLY APPARATUS

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventors: Liang Yao, Beijing (CN); Lin Huang, Beijing (CN); Wei Zhou, Beijing (CN); Yu Yang, Beijing (CN); Giseub Lim, Beijing (CN); Erlun Chen, Beijing (CN); Chen Yuan, Beijing (CN); Liming Xu, Beijing (CN); Chengnan Hsieh, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 270 days.

(21) Appl. No.: 15/276,864

(22) Filed: Sep. 27, 2016

(65) Prior Publication Data

US 2017/0266698 A1 Sep. 21, 2017

(30) Foreign Application Priority Data

Mar. 21, 2016 (CN) ..... 2016 1 0161409

(51) Int. Cl.

| | |
|---|---|
| ***B08B 1/00*** | (2006.01) |
| ***B05B 1/04*** | (2006.01) |
| ***B05C 5/00*** | (2006.01) |
| ***B05B 15/522*** | (2018.01) |

(Continued)

(52) U.S. Cl.
CPC ..... *B08B 1/005* (2013.01); *B05B 1/044* (2013.01); *B05B 15/5223* (2018.02);
(Continued)

(58) Field of Classification Search
CPC ..... B08B 1/005; B08B 1/007; B08B 1/008; B08B 9/00; B08B 9/021; B08B 9/027;
(Continued)

(56) References Cited

U.S. PATENT DOCUMENTS 5,381,962 A * 1/1995 Teague ..... B05B 12/00 239/525
5,389,147 A 2/1995 Shigesada et al.

FOREIGN PATENT DOCUMENTS

CN 201886235 U 6/2011
CN 102161028 A 8/2011
(Continued)

OTHER PUBLICATIONS

Machine Translation of Fumihiro et al., JP-2011167612-A, Sep. 2011. (Year: 2011).*
(Continued)

*Primary Examiner* — David G Cormier
(74) *Attorney, Agent, or Firm* — Brooks Kushman P.C.

(57) ABSTRACT

A liquid knife cleaning apparatus and a liquid knife are provided. The liquid knife cleaning apparatus includes: a frame configured to be arranged on the liquid knife and be capable of reciprocating in an extending direction of the knife edge; a cleaning blade configured to extend into the knife edge of the liquid knife and be capable of reciprocating inside the knife edge under the driving of the frame to clean the knife edge, the cleaning blade being arranged on the frame; and a movable mechanism configured to control the
(Continued)

frame to reciprocate on the liquid knife in the extending direction of the knife edge, the frame being connected to the movable mechanism.

5 Claims, 4 Drawing Sheets

(51) Int. Cl.
*B08B 9/00* (2006.01)
*B05C 5/02* (2006.01)

(52) U.S. Cl.
CPC ..... *B05C 5/005* (2013.01); *B08B 1/008* (2013.01); *B08B 9/00* (2013.01); *B05C 5/0254* (2013.01)

(58) Field of Classification Search
CPC ..... B05B 15/50; B05B 15/52; B05B 15/522; B05B 15/5223; B05B 1/044; B05B 5/005
See application file for complete search history.

(56) References Cited

FOREIGN PATENT DOCUMENTS

| | | | | |
|---|---|---|---|---|
| CN | 202909970 | U | | 5/2013 |
| CN | 203235718 | U | | 10/2013 |
| CN | 203642643 | U | | 6/2014 |
| DE | 19847713 | C2 | | 8/2001 |
| EP | 0216948 | A1 | | 4/1987 |
| JP | 2011167612 | A | * | 9/2011 |

OTHER PUBLICATIONS

First Office Action for Chinese Application No. 201610161409.0, dated Jun. 28, 2017, 7 Pages.

* cited by examiner

LIQUID KNIFE, LIQUID KNIFE CLEANING APPARATUS AND LIQUID KNIFE ASSEMBLY APPARATUS

CROSS-REFERENCE TO RELATED APPLICATIONS

This application claims priority to Chinese application No. 201610161409.0, filed Mar. 21, 2016, which is hereby incorporated by reference in its entirety.

TECHNICAL FIELD

The disclosure relates to the field of displays, and in particular, to a liquid knife, a liquid knife cleaning apparatus and a liquid knife assembly apparatus.

BACKGROUND

The primary purpose of a color film factory in the tin film transistor-liquid crystal display (TFT-LCD) is to coat photoresist of different colors on a glass substrate and prepare patterns of different colors through exposure, development, post-baking and other processes. The purpose of the developing process of the color film factory is to remove unexposed photoresist on the substrate, retain the exposed photoresist pattern, rinse the glass substrate after exposure with a solution of diluted potassium hydroxide (KO) and then rinse the glass substrate with pure water to remove KO residual liquid. A liquid knife apparatus is added in a connection region between a developing section and a cleaning section of a developing device to rapidly clear the KO residual liquid and development residue on a surface of the substrate, thereby reducing the blocking of a filter in the cleaning section. However, water curtain bifurcation may occur in the uninterrupted production of the liquid knife for a long period of time, and the main reason is because the development residue or other foreign matter falls into a knife edge of the liquid knife and blocks a flow direction. The bifurcated liquid curtain generated due to the residual foreign matter in the liquid knife causes poor development, generating the poor development (Mura) and other undesirable qualities.

To solve the above-mentioned problem, an approach in the related art includes manually cleaning liquid curtain after the equipment is shut down. Specifically, the primarily actions include stuffing a sheet inside a knife edge of a liquid knife in a developing machine, cleaning the interior of the knife edge of the liquid knife automatically back and forth several times in a certain speed, regularly cleaning the residual foreign matter inside the liquid knife in a certain frequency, and the production line is resumed after the cleaning is confirmed to be OK. However, the utilization of the equipment is affected and there is a risk of poor products.

SUMMARY

An object of the disclosure is to provide a liquid knife cleaning apparatus, a liquid knife and a liquid knife assembly apparatus. The liquid knife cleaning apparatus can replace the conventional manual cleaning way to clean a knife edge of a liquid knife, and can reduce the probability of the liquid curtain bifurcation occurring, thereby reducing the probability of a development MURA occurring and improving utilization of the apparatus.

Technical solutions according to the disclosure are provided as follows.

A liquid knife cleaning apparatus is adapted to clean a liquid knife with a knife edge. The liquid knife cleaning apparatus includes: a frame configured to be arranged on the liquid knife and be capable of reciprocating in an extending direction of the knife edge; a cleaning blade configured to extend into the knife edge of the liquid knife and be capable of reciprocating inside the knife edge under driving of the frame to clean the knife edge, the cleaning blade being arranged on the frame; and a movable mechanism configured to control the frame to reciprocate on the liquid knife in the extending direction of the knife edge, the frame being connected to the movable mechanism.

Further, the frame includes: a first side frame and a second side frame arranged on two opposite sides of the liquid knife; and a bottom frame arranged below the knife edge of the liquid knife, the bottom frame being connected to the first side frame and the second side frame. The cleaning blade is arranged on the bottom frame.

Further, the frame is V-shaped.

Further, the liquid knife cleaning apparatus includes an adjustment scroll configured to adjust a first height of the cleaning blade extending into the knife edge.

Further, the adjustment scroll includes a scroll arranged on the frame; the cleaning blade is a soft blade, one end of the cleaning blade extends toward the knife edge of the liquid knife, the other end of the cleaning blade is wound on the scroll, and the rotation of the scroll can control the soft blade to be stretched out and drawn back to adjust the first height of the cleaning blade extending into the knife edge.

Further, the adjustment scroll further includes a restriction component arranged on the scroll.

Further, a guide rail is arranged in the extending direction of the knife edge on the liquid knife; the movable mechanism includes: a movable component configured to be cooperated with the guide rail on the liquid knife and reciprocate on the guide rail, the movable component being arranged on the frame; and a driving structure configured to drive the movable component to move on the guide rail.

Further, the guide rail includes: protruding portions protruded on two sides of the liquid knife and extending in the extending direction of the knife edge; the movable component includes: hook portions capable of being cooperated with the protruding portions.

Further, the guide rail includes: groove structures arranged in two sides of the liquid knife and extending in the extending direction of the knife edge; the movable component includes: hook portions capable of being cooperated with the groove structures.

Further, the movable mechanism further includes: a control unit configured to control an operating state of the driving structure to control a moving state of the frame, thereby controlling an operating state of the cleaning blade.

A liquid knife includes a cooperating structure cooperated with the movable mechanism of the liquid knife cleaning apparatus as described above.

Further, the cooperating structure includes: a guide rail arranged in the extending direction of the knife edge, and the guide rail is arranged on the liquid knife.

Further, the guide rail includes: protruding portions protruded on two sides of the liquid knife and extending in the extending direction of the knife edge; or the guide rail includes: groove structures arranged in two sides of the liquid knife and extending in the extending direction of the knife edge.

A liquid knife assembly apparatus is provided according to the disclosure, which includes: a liquid knife with a knife edge and a liquid knife cleaning apparatus. The liquid knife cleaning apparatus includes a frame and a cleaning blade arranged on the frame and corresponding to the knife edge. The frame is slidably sleeved on the liquid knife.

Further, the frame is V-shaped, and at least part of the knife edge is in the frame.

Further, the cleaning blade is inside the frame.

Further, the liquid knife assembly apparatus further includes a guide rail on the liquid knife, and a movable mechanism on the frame. The guide rail and the movable mechanism are cooperated with each other to control the frame to be slidable relative to the liquid knife in an extending direction of the knife edge.

Further, the movable mechanism includes a movable component slidably installed on the guide rail and a driving structure connected to the movable component.

The disclosure has advantageous effects as follows.

The liquid knife cleaning apparatus can replace the conventional manual cleaning way to clean the knife edge of the liquid knife, can reduce the probability of the liquid curtain bifurcation occurring, thereby reducing the probability of a development MURA occurring, improving utilization of the apparatus as well as avoiding other problems caused by discontinuous process.

DETAILED DESCRIPTION

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

To make the object, technical solutions and advantages of the disclosure more clear, in the following, the technical solutions in embodiments of the disclosure are illustrated clearly and completely in conjunction with the accompanying drawings of the embodiments of the disclosure. It is apparent that the described embodiments are only a part of embodiments of the present disclosure, rather than all embodiments. Other embodiments obtained by those skilled in the art on the basis of the described embodiments of the present disclosure without creative work fall into the scope of protection of the present disclosure.

Figure 1:
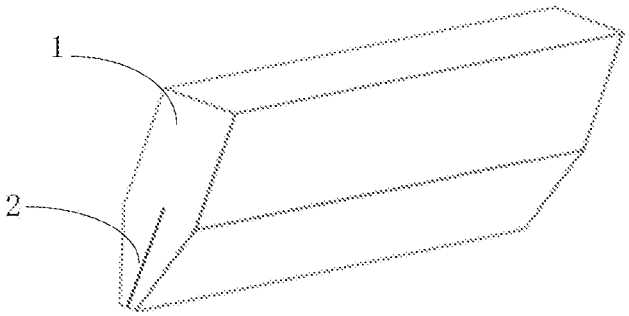
FIG. 1 is a perspective view of a liquid knife in the related art.
Figure 2:
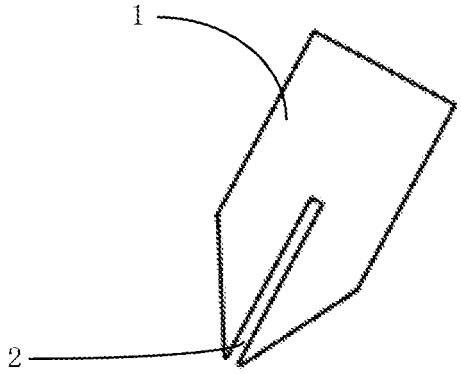
FIG. 2 is a front view of the liquid knife in the related art.
Figure 8:
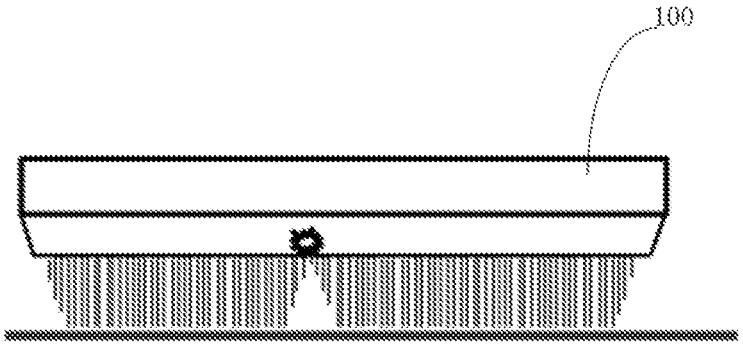
FIG. 8 illustrates a schematic front view of abnormal liquid curtain ejected by a liquid knife.

FIG. 1 and FIG. 2 are schematic diagrams of a liquid knife of a cleaning device or a development device in the related art. The liquid knife is mainly made of SUS (stainless steel) material. As shown in FIG. 1 and FIG. 2, the liquid knife 1 has a slit-shaped knife edge 2, and all slit widths of the knife edge 2 of the liquid knife 1 are substantially identical. The slit widths of the knife edge 2 of the liquid knife 1 generally are of 0.1 mm±0.015 mm. Cleaning agent or developer liquid flows uniformly out of slits of the knife edge 2 of the liquid knife 1 to rinse a surface of the substrate. Liquid curtain bifurcation (as shown in FIG. 8) may occur in the uninterrupted production and usage of the liquid knife for a long period of time, even seriously, developing horizontal line (Mura) may occur.

The approach of cleaning the liquid knife in the related art includes: necessarily shutting down the equipment, inserting a thin-long cleaning blade (film) into the knife edge of the liquid knife to scrape inner walls of the knife edge of the liquid knife from left to right and back to left, finishing the cleaning operation when it is visually observed that the fluid flow is not bifurcated, and then restarting the equipment subsequently, which causes the utilization of the equipment to be decreased and tends to improve a risk in quality.

As shown in FIGS. 3-6, a liquid knife cleaning apparatus according to embodiments of the disclosure includes a frame 200, a cleaning blade 300 and a movable mechanism.

The frame 200 is to be arranged on a liquid knife 100 and is capable of reciprocating in an extending direction of a knife edge 101 of the liquid knife 100.

The cleaning blade 300 is to extend into the knife edge 101 of the liquid knife 100 and is capable of reciprocating inside the knife edge 101 under the driving of the frame 200 to clean the knife edge 101. The cleaning blade 300 is arranged on the frame 200.

The movable mechanism is to control the frame 200 to reciprocate on the liquid knife 100 in the extending direction of the knife edge 101. The frame 200 is connected to the movable mechanism.

The liquid knife cleaning apparatus according to the disclosure can replace the conventional manual cleaning way to clean the knife edge 101 of the liquid knife 100, and can reduce the probability of the liquid curtain bifurcation occurring, thereby reducing the probability of a development MURA occurring, improving the utilization of the apparatus as well as avoiding other problems caused by discontinuous process.

An optional example of the liquid knife cleaning apparatus according to one embodiment of the disclosure is illustrated below.

Figure 5:
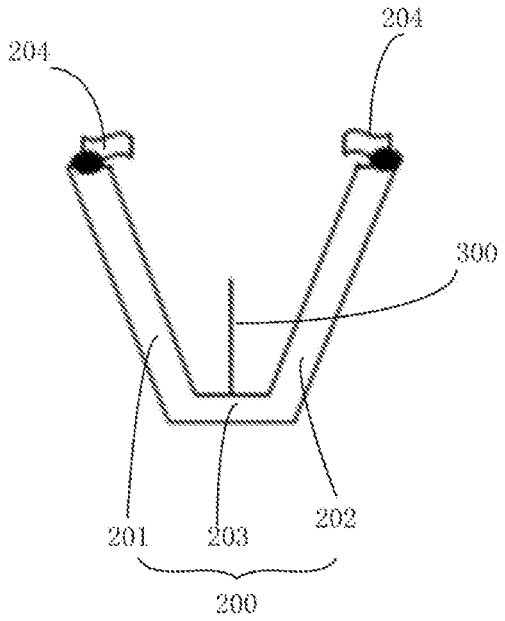
FIG. 5 is a schematic diagram of a liquid knife cleaning apparatus according to one embodiment of the disclosure.
Figure 6:
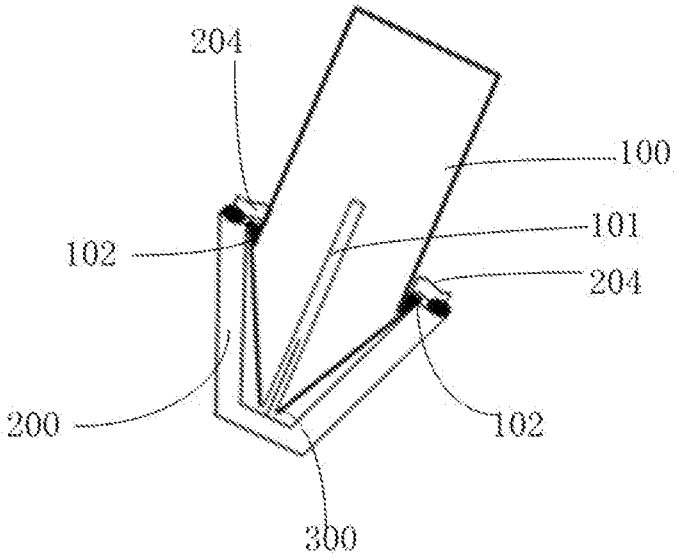
FIG. 6 is a schematic diagram of the liquid knife cleaning apparatus when cleaning a liquid knife according to one embodiment of the disclosure.

In one embodiment, optionally, as shown in FIGS. 5-6, the frame 200 includes: a first side frame 201, a second side frame 202 and a bottom frame 203. The first side frame 201 and the second side frame 202 are arranged on two opposite sides of the liquid knife 100. The bottom frame 203 is arranged below the knife edge 101 of the liquid knife 100. The bottom frame 203 is connected to the first side frame 201 and the second side frame 202. The cleaning blade 300 is arranged on the bottom frame 203.

As shown in FIG. 5, in the above-described technical solution, a V-shaped structure is defined by the first side frame 201, the second side frame 202 and the bottom frame 203 of the frame 200, which is matched with the liquid knife 100. It should be understood that the structure of the frame 200 may be in various forms in actual applications, which is not limited herein.

In addition, in one embodiment, optionally, the liquid knife cleaning apparatus further includes an adjustment scroll configured to adjust a first height of the cleaning blade 300 extending into the knife edge 101.

In the above-described technical solution, the first height of the cleaning blade 300 which extends into the knife edge 101 of the liquid knife 100 may be adjusted by the adjustment scroll. Therefore, the liquid knife cleaning apparatus is adapted to clean knife edges 101 of different depths.

Figure 9:
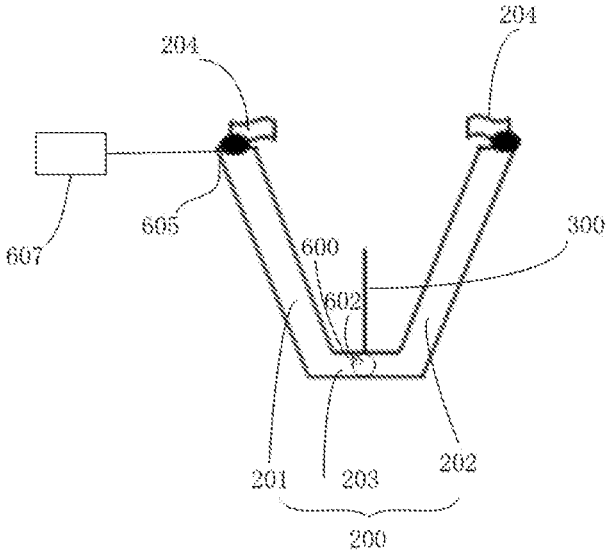
FIG. 9 is a schematic diagram of a liquid knife cleaning apparatus according to one embodiment of the disclosure.

In one embodiment, optionally, as shown in FIG. 9, the adjustment scroll includes a scroll 600 arranged on the frame 200. The cleaning blade 300 is a soft blade. One end of the cleaning blade 300 extends toward the knife edge 101 of the liquid knife 100, and the other end of the cleaning blade 300 is wound on the scroll 600. The rotation of the scroll 600 can control the soft blade to be stretched out and drawn back to adjust the first height of the cleaning blade 300 extending into the knife edge 101.

In the above-described technical solution, the first height of the soft blade extending into the knife edge 101 can be adjusted by rotating the scroll to stretch out and draw back the soft blade. The scroll and the soft blade are cooperated in the adjustment scroll, with a simple structure and easy operation. It can be understood that, the adjustment scroll may be configured to be other structures, which are not listed one by one herein.

In addition, it should be noted that, the adjustment scroll further includes a restriction component 602 arranged on the scroll for restricting the cleaning blade 300, in a case that the first height of the cleaning blade 300 extending into the knife edge 101 is a specified height, as shown in FIG. 9.

Figure 3:
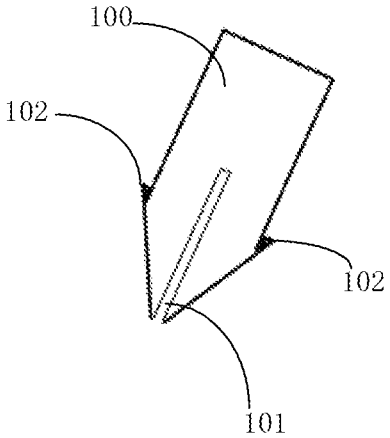
FIG. 3 is a front view of a liquid knife according to one embodiment of the disclosure.
Figure 4:
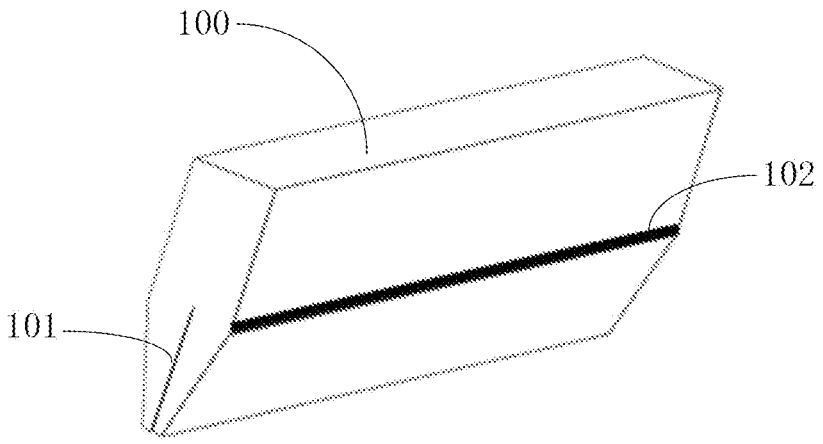
FIG. 4 is a perspective view of the liquid knife according to one embodiment of the disclosure.

Moreover, in the embodiment, the structure of the liquid knife 100 is modified to be matched with the liquid knife cleaning apparatus according to the embodiment of the disclosure. As shown in FIG. 3, FIG. 4 and FIG. 6, a guide rail 102 is arranged in the extending direction of the knife edge 101 on the liquid knife 100 according to the embodiment of the disclosure.

In the embodiment, the movable mechanism includes a movable component and a driving structure 605. The movable component is cooperated with the guide rail 102 on the liquid knife 100 and reciprocates on the guide rail 102. The movable component is arranged on the frame 200. The driving structure 605 is to drive the movable component to move on the guide rail 102, as shown in FIG. 9.

In the above-described technical solution, the guide rail 102 is added on an outer wall of the liquid knife 100 according to the disclosure, and is used to hold the liquid knife cleaning apparatus according to the embodiment of the disclosure. The liquid knife cleaning apparatus is fixed on the liquid knife 100 through engagement between the movable component on two sides of the frame 200 and the guide rail 102 on two sides of the liquid knife 100. When a cleaning operation is not performed, the frame 200 stays at a location closest to the right edge of the liquid knife 100, which may not cause liquid curtain bifurcation. The guide rail 102 is cooperated with the movable component on the frame 200 to control a movement direction of the frame 200. A driving force for the movement of the frame 200 is supplied by the driving structure. The liquid knife cleaning apparatus is fixed on the liquid knife 100 via a guiding mechanism such as the guide rail 102 on two sides of the liquid knife 100. The driving structure may specifically be in various forms, for example, a form of cooperating a screw rod with a servo motor, or a form of cooperating a spiral rod with a driving motor. The specific driving structure is not limited herein.

In this embodiment, optionally, as shown in FIG. 3, FIG. 4 and FIG. 6, the guide rail 102 includes: protruding portions protruded on two sides of the liquid knife 100 and extending in the extending direction of the knife edge 101. The movable component includes: hook portions 204 cooperated with the protruding portions. The hook portions 204 may hook on the protruding portions.

In the above-described technical solution, the frame 200 is fixed on the liquid knife 100 by cooperating the protruding portions with the hook portions 204, with a simple cooperating structure of the protruding portions and the hook portions 204, which prevents abnormal fall risk.

In other embodiments of the disclosure, there may be several forms of cooperating the guide rail 102 of the liquid knife 100 with the movable component of the liquid knife cleaning apparatus. For example, the guide rail 102 includes: groove structures arranged in two sides of the liquid knife 100 and extending in the extending direction of the knife edge 101. The movable component includes: hook portions capable of being cooperated with the groove structures. It can be understood that, a specific cooperating structure of the guide rail 102 and the movable component is not limited herein.

In addition, in the embodiment of the disclosure, the movable mechanism further includes: a control unit 607 configured to control an operating state of the driving structure to control a moving state of the frame 200 and thus control an operating state of the cleaning blade 300, as shown in FIG. 9.

In addition, the control unit is further configured to control an operating state of the scroll to control the first height of the cleaning blade 300 extending into the knife edge 101.

In the above-described technical solution, the control unit may control the frame 200 to clean the inner walls of the liquid knife 100 along the guide rail 102 via wireless signals. A cleaning duration, a cleaning interval and the first height of the cleaning blade 300 of the liquid knife cleaning apparatus may be set and controlled.

The liquid knife cleaning apparatus according to the optional embodiment of the disclosure may be automatically clean the liquid knife 100 in a production interval in a case of not being shut down. The cleaning blade 300 of the apparatus is used to scrape the knife edge 101 of the liquid knife 100 back and forth to remove the residues, thereby reducing a risk in quality due to liquid curtain bifurcation. The liquid knife cleaning apparatus may adjust a cleaning frequency and a cleaning duration according to actual situations, for example, which can be set and controlled via a touch screen.

Figure 7:
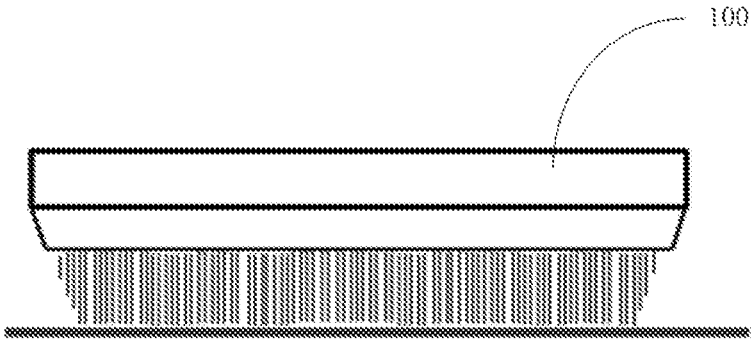
FIG. 7 illustrates a schematic front view of normal liquid curtain ejected by a liquid knife.

With the liquid knife cleaning apparatus according to the optional embodiment of the disclosure, the periodical cleaning may further be realized to prevent a risk of liquid curtain bifurcation abnormality occurring, thereby ensuring that the liquid curtain state is as shown in FIG. 7 after the cleaning is completed. If liquid curtain bifurcation occurs as shown in FIG. 8 in the production, the developing process may be paused at once, a setting operation may be performed on the touch screen and a cleaning operation is performed promptly, thereby ensuring the quality to be normal without seriously affecting the utilization of the equipment.

Furthermore, a liquid knife is provided according to one embodiment of the disclosure, which includes a cooperating structure cooperated with the movable mechanism of the liquid knife cleaning apparatus as described above.

Optionally, as shown in FIG. 3 and FIG. 4, in the liquid knife 100 according to one embodiment of the disclosure, the cooperating structure includes: a guide rail 102 arranged in the extending direction of the knife edge 101. The guide rail 102 is arranged on the liquid knife 100.

Optionally, as shown in FIG. 3 and FIG. 4, in the liquid knife 100 according to one embodiment of the disclosure, the guide rail 102 includes: protruding portions protruded on two sides of the liquid knife 100 and extending in the extending direction of the knife edge 101; or the guide rail 102 includes: groove structures arranged in two sides of the liquid knife 100 and extending in the extending direction of the knife edge 101.

Furthermore, a liquid knife assembly apparatus is further provided according to one embodiment of the disclosure. As shown in FIG. 6, the liquid knife assembly apparatus includes: a liquid knife 100 having a knife edge 101 and a liquid knife cleaning apparatus. The liquid knife cleaning apparatus includes a frame and a cleaning blade arranged on the frame and corresponding to the knife edge 101. The frame is slidably sleeved on the liquid knife 100.

The above-described embodiments are only preferred embodiments of the present disclosure. It should be noted that various modifications and substitutions may be made to the disclosure for those skilled in the art without departing from the technical principle of the disclosure, and these modifications and substitutions are also considered to fall into the protective scope of the disclosure.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A liquid knife cleaning apparatus for cleaning a liquid knife with a knife edge, wherein the liquid knife cleaning apparatus comprises:

a frame configured to be arranged on the liquid knife and be capable of reciprocating in an extending direction of the knife edge;

a cleaning blade configured to extend into the knife edge of the liquid knife and be capable of reciprocating inside the knife edge under driving of the frame to clean the knife edge; and a movable mechanism configured to control the frame to reciprocate on the liquid knife in the extending direction of the knife edge; wherein the frame comprises a first side frame and a second side frame arranged on two opposite sides of the liquid knife; and a bottom frame arranged below the knife edge of the liquid knife; the bottom frame is connected to the first side frame and the second side frame, and the cleaning blade is arranged on the bottom frame;

a distance between the first side frame and the second side frame varies along a direction perpendicular to the bottom frame;

the cleaning blade is on the whole frame; and the whole frame is connected to the movable mechanism;

the movable mechanism comprises a movable component arranged on the whole frame and configured to be cooperated with a guide rail on the liquid knife and reciprocate on the guide rail;

the movable component comprises hook portions configured to be cooperated with the guide rail;

wherein the liquid knife cleaning apparatus further comprises an adjustment scroll, the adjustment scroll is arranged on the whole frame to adjust a first height of the cleaning blade extending into the knife edge.

2. The liquid knife cleaning apparatus according to claim 1, wherein the whole frame is V-shaped.

3. The liquid knife cleaning apparatus according to claim 1, wherein the movable mechanism comprises a driving structure;

the driving structure is configured to drive the movable component to move on the guide rail.

4. The liquid knife cleaning apparatus according to claim 1, wherein the guide rail comprises: protruding portions protruded on two sides of the liquid knife and extending in the extending direction of the knife edge; the hook portions capable of being cooperated with the protruding portions; or the guide rail comprises: groove structures arranged in two sides of the liquid knife and extending in the extending direction of the knife edge; the hook portions capable of being cooperated with the groove structures.

5. The liquid knife cleaning apparatus according to claim 1, wherein the first side frame and the second side frame are getting closer to each other along a direction extending toward the bottom frame, and are getting further away from each other along a direction extending away from the bottom frame.

* * * * *